United States Patent [19]

Adams

[11] Patent Number: 4,465,024

[45] Date of Patent: Aug. 14, 1984

[54] WATER HEATER

[75] Inventor: Charles L. Adams, Euless, Tex.

[73] Assignee: PVI Industries Incorporated, Fort Worth, Tex.

[21] Appl. No.: 534,402

[22] Filed: Sep. 23, 1983

Related U.S. Application Data

[63] Continuation of Ser. No. 369,207, Apr. 16, 1982, abandoned.

[51] Int. Cl.[3] ..... F22B 5/00

[52] U.S. Cl. ..... 122/17; 126/360 A; 126/361

[58] Field of Search ..... 122/13 R, 14, 16, 42, 122/17, 74, 75, 136, 137; 126/360 R, 361, 391, 360 A

[56] References Cited

U.S. PATENT DOCUMENTS

| | | | |
|---|---|---|---|
| 156,573 | 11/1874 | Jones | 126/391 |
| 480,406 | 8/1892 | Kennedy | 122/17 |
| 953,023 | 3/1910 | Doran | 122/136 R |
| 2,385,854 | 10/1945 | Wolfersperger | 122/17 |
| 2,465,953 | 3/1949 | Wollner | 126/391 |
| 2,532,527 | 12/1950 | Woolery | 122/75 |
| 3,109,423 | 11/1963 | Reagan et al. | 126/360 R |
| 3,718,131 | 2/1973 | Busse et al. | 126/360 R |
| 3,757,745 | 9/1973 | Miller | 122/136 R |
| 3,776,199 | 12/1973 | Miller | 122/136 |
| 3,903,868 | 9/1975 | Solvo | 122/136 R |
| 4,203,392 | 5/1980 | McLane | 122/17 |
| 4,230,177 | 10/1980 | Berkestad | 165/67 |
| 4,301,772 | 11/1981 | Eising | 122/17 |
| 4,329,943 | 5/1982 | Schworer | 122/17 |

FOREIGN PATENT DOCUMENTS

| | | | |
|---|---|---|---|
| 2415608 | 10/1975 | Fed. Rep. of Germany | 126/391 |
| 791727 | 3/1958 | United Kingdom | 122/17 |

*Primary Examiner*—Henry C. Yuen

*Attorney, Agent, or Firm*—Saidman, Sterne & Kessler

[57] ABSTRACT

A water heater is shown which has a water tank having a water inlet, a water outlet, and an opening in a sidewall of the tank. A combustion chamber assembly has a submergible portion which is adapted to be received within the opening in the tank sidewall. The combustion chamber assembly has a mounting flange for detachably engaging a tank mounting flange for mounting the assembly within the tank. The combustion chamber assembly has a plurality of curved fire tubes. Each of the tubes has at least one end which communicates through the mounting flange with the tank exterior. The combustion chamber assembly is removable from the tank by detaching the mounting flanges and sliding the assembly out of the tank opening.

12 Claims, 2 Drawing Figures

WATER HEATER

This application is a continuation of application Ser. No. 369,207, filed Apr. 16, 1982, now abandoned.

BACKGROUND OF THE INVENTION

The present invention relates generally to gas/oil fired commercial and residential water heaters and specifically to a gas/oil fired water heater having a replaceable submerged combustion chamber assembly with curved fire tubes which is submergible in the water heater tank.

In conventional gas/oil fired water heaters, hot gas flows through a series of vertically mounted tubes which are mounted in vertical fashion between top and bottom support plates within the water heater tank. Water flows into and out of a chamber located between the support plates and contacts and circulates about the exterior of the vertical tubes to effect heat transfer to heat the water.

Typical prior art gas/oil fired water heaters featured non-pressurized external combustion chambers. The location of the combustion chamber on the exterior of the water heater results in lost heat and lower combustion efficiency. The tubes and support plates were not easily accessible and required disassembly of the entire tank for maintenance and replacement.

There has existed a need for a gas/oil fired water heater design with a replaceable submerged combustion chamber assembly which could be easily replaced if maintenance was required without disassembly of the entire device.

There has also existed a need for a water heater design which minimizes the internal stress on the submerged combustion chamber fire tubes to provide longer operating life and reduced maintenance requirements.

A need has also existed for a water heater with a submergible, pressurized combustion chamber so that all combustion takes places in the water heater tank interior in a chamber surrounded by water for virtually zero heat loss and increased efficiency.

SUMMARY OF THE INVENTION

The present water heater has a water tank having a water inlet, a water outlet, and an opening in a sidewall of the tank. A combustion chamber assembly is provided having a submergible portion adapted to be received within the tank opening and having a mounting portion for mounting the assembly within the tank. The combustion chamber assembly has a plurality of curved fire tubes, each of the tubes having at least one end thereof which extends through the opening to the tank exterior. The assembly can be removed from the tank by detaching the mounting portion.

Preferably the combustion chamber assembly has a submergible combustion chamber portion which is adapted to be received within the tank opening and a mounting portion for detachably engaging the tank opening for mounting the assembly within the tank. The combustion chamber portion has an open end located adjacent the mounting portion which communicates with the tank exterior and has a closed end. A plurality of curved fire tubes communicate with the combustion chamber through the chamber closed end and have opposite ends which extend to the exterior of the tank.

The fire tubes are characterized in that at least a portion of the thereof are generally U-shaped.

The water tank preferably has a top, a bottom, and vertical sidewalls therebetween and has a water inlet, a water outlet, and an opening in the vertical sidewalls. The opening in the sidewalls is surrounded by an outwardly extending mounting flange. The combustion chamber assembly has a tube mouting flange for detachably engaging the tank mounting flange for mounting the assembly within the tank. The combustion chamber portion open end is connected to the tube mounting flange and communicates with the tank exterior. The combustion chamber assembly curved fire tubes communicate with the combustion chamber through the chamber closed end and have opposite ends which extend to the tube mouting flange and communicate through the tube mounting flange to the tank exterior.

A flue collector can be mounted on the tube mounting flange which has an opening therein which communicates with the combustion chamber open end and which has an annular chamber surrounding the collector opening and separated therefrom which communicates with the fire tube opposite ends. The annular chamber can be provided with a flue outlet.

A burner means can be mounted on the flue collector and can communicate with the flue collector opening for supplying heat to the tank. Heat from the burner passes through the submerged combustion chamber, through the fire tubes, into the flue collector, and out of the flue outlet. The combustion chamber assembly is removable from the tank by detaching the tube mounting flange.

Additional objects, features, and advantages will be apparent in the written description which follows.

DETAILED DESCRIPTION OF THE INVENTION

Figure 1:
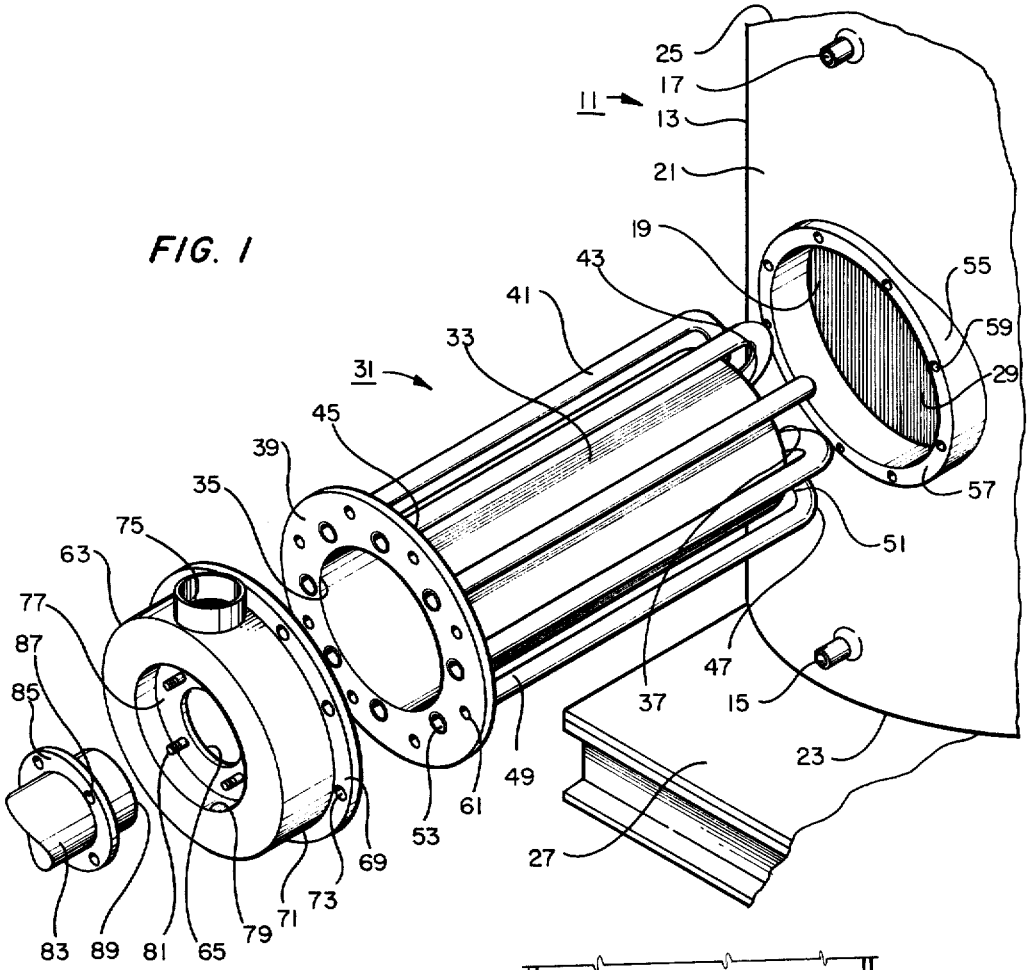
FIG. 1 is a partial persepctive view of the water heater of the invention showing the parts in exploded fashion.

Turning to FIG. 1, there is shown a water heater of the present invention designated generally as 11. The water heater 11 includes a water tank 13 of the type having a water inlet 15, a water outlet 17, and an opening 19 in a sidewall 21 of the tank 13. Tank 13 can be of the conventional flanged and dish design and have a top 25 (shown broken away), and a bottom 23 which is adapted to stand or be supported in vertical fashion on a support area 27. The interior 29 of tank 13 is empty in the disassembled state shown in FIG. 1 and forms a water chamber for circulation of water passing into water inlet 15 and out of water outlet 17.

A combustion chamber assembly designated generally as 31 in FIG. 1 has a submergible portion which is adapted to be received within opening 19 in tank 13. The submergible portion of the assembly includes a submersible combustion chamber portion 33 adapted to be received within the tank opening 19. Submergible combustion chamber portion 33 comprises a cylindrical elongated member having an open end 35 and having an opposite closed end 37. The combustion chamber assembly 31 also includes a mounting portion for detachably engaging the tank opening 19 for mounting the assembly 31 within the tank. The mounting portion can conveniently comprise a tube mounting flange 39 located adjacent and connected to the combustion chamber open end 35 as shown in FIG. 1. The tube mounting flange 39 is a ring like body having an opening in the central part thereof which opening coincides with the opening in open end 35 of combustion chamber 33. Flange 39 is securely affixed to chamber 33 as by welding or the like.

As seen in FIG. 1, the combustion chamber assembly 31 also includes a plurality of curved fire tubes 41 each of which has an end 43 which communicates with combustion chamber 33 through closed end 37 (see FIG. 2) and which has an opposite end 45 which extends through the opening 19 when in place on tank 13 to the tank exterior. Each of curved tubes 41 is characterized in that at least a portion 47 of the length thereof is generally U-shaped. The configuration shown in FIG. 1 has a combustion chamber 33 which extends substantially the length of the curved fire tubes 41 creating a long leg 49 running along the exterior of the combustion chamber 33 and separated by U-shaped portion 47 from a short leg 51 (see FIG. 2) which joins and extends through closed end 37. It will be understood that the length of combustion chamber 33 can be varied such as by shortening the length of the chamber, thereby increasing the length of leg 51 of tubes 41.

The ends 45 of curved tubes 41, as shown in FIG. 1, preferably extend to the tube mounting flange 39 and communicate through flange 39 by means of openings 53 with the tank exterior when the assembly 31 is received within the opening 19. The tube ends 45 are fixedly secured to flange 39 as by brazing the tube ends on the front and back sides of flange 39. Although a small number of curved tubes 41 are shown in FIG. 1 for simplicity, a greater number of tubes and openings can be used in practice. Although steel can be used in constructing the curved tubes 41, other acceptable material include copper, 90–10 copper-nickel alloy, titanium, and stainless steel.

The combustion chamber assembly 31 can be mounted on the tank 13 by providing a tank mounting flange 55 comprising a cylindrical ring which is fixedly connected to the tank exterior so as to circumscribe the opening 19 in tank 13 and to extend outwardly therefrom generally normal to the vertical sidewalls 21 of tank 13. The end area 57 of tank mounting flange 55 can be provided with a plurality of threaded bores 59 which are suitably spaced and alignable with matching bores 61 in tube flange 39 whereby the fire tube assembly 31 can be bolted to the tank mounting flange 55. In this way, the combustion chamber assembly 31 is removable from the water tank 13 by detaching the tube mounting flange 39 and sliding the assembly out of the opening 19. Because of the arrangement of opening 19 in the vertical sidewall 21 of the tank 13, the combustion chamber assembly 31 is mounted in a horizontal fashion with the longitudinal axis of the assembly 31 parallel to the plane of the support area 27.

As shown in FIG. 1, a flue collector 63 is mounted on the tube mounting flange 39 and has an opening 65 which communicates with the combustion chamber portion 33 and an annular chamber 67 which communicates with the fire tubes 41 by means of openings 53 in flange 39. A circumferential lip 69 joins the base 71 of annular chamber 67 and is provided with a plurality of holes 73 which are alignable with bores 61 in flange 39 and threaded bores 59 in tank mounting flange 55 whereby flue collector 63 can be mounted on the exterior of the tank 13. Flue collector 63 has a flue outlet 75 which communicates with the interior of annular chamber 67 and which can be connected to a flue pipe for carrying away waste gas as will be presently described.

The opening 65 in flue collector 63 which communicates with chamber 33, as seen in FIG. 1, is provided in a circular partition 77 formed in the internal diameter 79 of the exterior portion of annular chamber 71. Partition 77 can be provided with a plurality of threaded lugs 81 which are fixed about the circumference of opening 65 and extend outwardly in normal relation thereto. A suitable heat source such as a burner means is mounted on the flue collector 63 and communicates with the flue collector opening 65 for supplying heat to tank 13.

Figure 2:
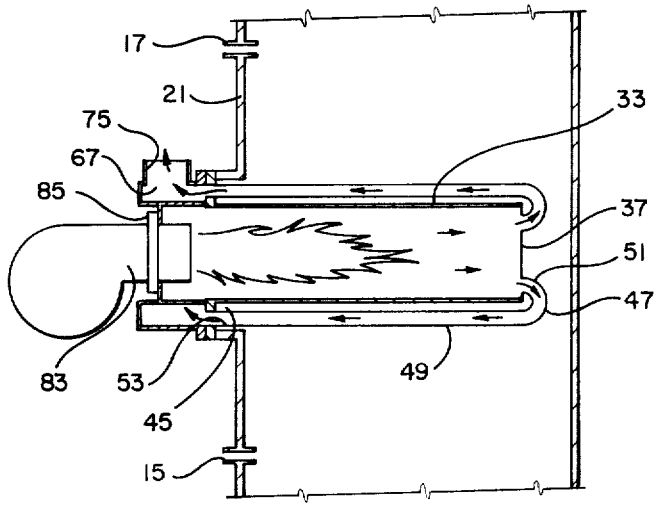
FIG. 2 is a side cross-sectional isometric view showing the operation of the water heater of FIG. 1.

The heat source, as shown in FIGS. 1 and 2, can comprise a burner nozzle 83 from a forced draft burner which has a circumferential ring 85 provided with a series of holes 87 which mate with and receive lugs 81 on partition 77 for bolting the nozzle 83 onto the flue collector 63. In this way, the nozzle burner opening 89 can communicate with the combustion chamber 33 whereby heat from the burner passes through the interior of the submerged combustion chamber 33 and through the fire tubes 41, into the annular chamber 67 of the flue collector 63, and out the flue outlet 75 to be exhausted. Preferably, the nozzle burner 83 is suitably constructed to work against a positive pressure.

The operation of the present water heater will now be described in greater detail. The water heater is first assembled by mounting the fire tube assembly 31 within opening 19 in tank 13. The bores 61 in fire tube flange 39 are aligned with the threaded bores 59 in tank flange 55 and the flue collector 63 is positioned over flange 39 with the flue outlet 75 directed upwardly with respect to the vertical sidewalls 21. The holes 73 in circumferential lip 69 of flue collector 63 are aligned with bores 61 and the flue collector 63 and fire tube flange 39 are bolted onto the tank flange 55. The nozzle burner 83 is then bolted into place on partition 77 in flue collector 63 and water is introduced into the tank interior 29 through water inlet 15. In the configuration shown in FIG. 1, the burner is fired to introduce hot gas into the combustion chamber 33 to provide a positive pressure within chamber 33 with the flue gases passing out the curved fire tubes 41 and through the flue collector annular chamber 67 to the flue outlet 75 to be exhausted from the system. The burner 83 is switched off and on as needed to maintain the desired temperature level of the water contained in the tank in response to a conventional temperature control circuit of the type known in the art and familiar to those in the water heater industry.

Water heaters as distinguished from boilers and heat exchangers are limited by the ASME code to maximum internal pressure of approximately 160 psi or approximately 210° F. A water heater was constructed as in FIG. 1 using curved tubes made of coppper. Gas was introduced into the system at approximately 70° F. and heated by the nozzle burner 83 to approximately 2800° F. The water temperature was monitored along with the stack or flue gas temperature exiting the stack from the flue outlet 75. ASME standards allow a flue gas temperature as high as 480° F. which correlates to a combustion efficiency of approximately 70%. The combustion efficiency is calculated by measuring the flue gas temperature subtracting the ambient air temperature and measuring the $CO_2$ content of the flue gas. By using known charts, the combustion efficiency can be determined. With the device shown in FIGS. 1 and 2 a combustion efficiency of 85% has been achieved.

An invention has been provided with significant advantages. The present water heater has a submergible combustion chamber assembly which can be easily removed for repair or replacement. Because of the curved fire tube design and the absence of support plates, stress and corrosion are reduced. The resulting cooler flue gas temperature (250° F.) allows the flue pipe diameter to be reduced, e.g., from approximately 6 inches for a 250,000 BTU water heater to approximately 3–4 inches. Because copper material is satisfactory in the instant application, water pipe copper tubing of ¼ to 2 inches in internal diamter can be obtained off the shelf and used for the curved fire tubes thereby reducing the cost of manufacturing specialized parts. The assembly is simple in design and inexpensive to manufacture since the copper curved fire tubes can be produced from commercially available stock pipe.

While the invention has been shown in only one of its forms, it will be appreciated that it is not thus limited but is susceptible to various changes and modifications without departing from the spirit thereof.

I claim:

1. A gas or oil fired water heater, which comprises:

a closed tank normally containing water under pressure and having a top, a bottom, a sidewall extending between said top and bottom, a water inlet, a water outlet and an opening in said sidewall;

a combustion chamber assembly having a submergible, pressurized combustion chamber portion with multiple external heating surfaces, said combustion chamber portion normally extending through said sidewall opening of said closed tank so that all of said heating surfaces are submerged in said water under pressure;

said combustion chamber assembly including means for readily removing same from and installing same in said opening, said means comprising a mounting portion for detachably but sealingly engaging said tank opening;

said combustion chamber portion comprising a substantially cylindrical body portion having an open end located adjacent said mounting portion which communicates with the exterior of said water tank and a closed end at the opposite end of said body portion;

said multiple external heating surfaces including a multiplicity of substantially U-shaped fire tubes of substantially smaller diameter than and spaced equidistantly about the entire periphery of said body portion, each of said fire tubes having a long leg and a short leg;

said short leg of each of said fire tubes extending through said closed end of said body portion to communicate with the interior of said combustion chamber portion at said closed end;

said long leg of each of said fire tubes extending adjacent said body portion through said mounting portion to the exterior of said water tank;

a flue collector mounted on the exterior of said water tank and having a flue opening therein which communicates with said open end of said body portion, said flue collector having an annular chamber surrounding said flue opening and separated therefrom, said annular chamber communicating with said long leg of each of said fire tubes, said annular chamber having a flue outlet therein; and a forced draft burner mounted on the exterior of said water tank and communicating with said combustion chamber opening for causing combustion to take place within said body portion of said submergible, pressurized combustion chamber portion so that substantially all combustion takes place within said water tank to minimize heat loss.

2. The water heater as set forth in claim 1, wherein said mounting portion comprises a first mounting flange connected to and extending about the periphery of said open end of said combustion chamber body portion.

3. The water heater as set forth in claim 2, wherein said opening in said tank includes a second mounting flange extending about the periphery thereof and having a plurality of threaded bores therein.

4. The water heater as set forth in claim 3, wherein said first mounting flange also includes a plurality of bores that are alignable with said threaded bores in said second mounting flange for removably receiving bolts therethrough.

5. The water heater as set forth in claim 4, wherein said flue collector further includes a circumferential lip extending about the periphery of said annular chamber, said lip including a plurality of holes which are alignable with said bores in said first mounting flange and said threaded bores in said second mounting flange for removably receiving said bolts therethrough to connect said flue collector to said combustion chamber assembly and to said opening.

6. The water heater as set forth in claim 1, wherein said flue collector includes a circular partition extending inwardly from the exterior of said annular chamber around said flue opening, said partition including mounting lugs thereon.

7. The water heater as set forth in claim 6, wherein said burner includes a nozzle for mounting through said flue opening and a ring extending about the circumference of said nozzle, said ring having a series of holes which mate with and receive said mounting lugs for connecting said burner to said flue collector.

8. The water heater as set forth in claim 5, wherein said flue collector includes a circular partition extending inwardly from the exterior of said annular chamber around said flue opening, said partition including mounting lugs thereon.

9. The water heater as set forth in claim 8, wherein said burner includes a nozzle for mounting through said flue opening and a ring extending about the circumference of said nozzle, said ring having a series of holes which mate with and receive said mounting lugs for connecting said burner to said flue collector.

10. The water heater as set forth in claim 1, wherein heat from said burner passes through said combustion chamber, through said fire tubes, into said flue collector, and out said flue outlet.

11. The water heater as set forth in claim 9, wherein heat from said burner passes through said combustion chamber, through said fire tubes, into said flue collector, and out said flue outlet.

12. The water heater as set forth in claim 1, wherein each of said fire tubes include a curved portion connecting said short leg to said long leg.

* * * * *